US006078027A

United States Patent [19]

Natsuhara et al.

[11] Patent Number: 6,078,027

[45] Date of Patent: Jun. 20, 2000

[54] CERAMIC FIXING HEATER CONTAINING SILICON NITRIDE

[75] Inventors: Masuhiro Natsuhara; Hirohiko Nakata; Yasuhisa Yushio, all of Itami, Japan

[73] Assignee: Sumitomo Electric Industries, Ltd., Osaka, Japan

[21] Appl. No.: 09/153,789

[22] Filed: Sep. 15, 1998

[30] Foreign Application Priority Data

Sep. 17, 1997 [JP] Japan ..... 9-251906

[51] Int. Cl.[7] ..... H05B 1/00

[52] U.S. Cl. ..... 219/216; 219/469; 219/487; 399/330

[58] Field of Search ..... 219/216, 469–487; 339/330–335; 430/60, 228; 492/46; 118/60

[56] References Cited

U.S. PATENT DOCUMENTS

| | | | |
|---|---|---|---|
| 5,001,089 | 3/1991 | Kasori et al. . | |
| 5,051,784 | 9/1991 | Yamamoto et al. . | |
| 5,162,634 | 11/1992 | Kusaka et al. . | |
| 5,241,155 | 8/1993 | Koh et al. . | |
| 5,278,618 | 1/1994 | Mitani et al. . | |
| 5,365,314 | 11/1994 | Okuda et al. . | |
| 5,376,773 | 12/1994 | Masuda et al. . | |
| 5,499,087 | 3/1996 | Hiraoka et al. | 355/285 |
| 5,660,750 | 8/1997 | Kusaka . | |
| 5,732,318 | 3/1998 | Natsuhara et al. | 399/329 |
| 5,860,052 | 1/1999 | Ohtsuka et al. | 399/329 |

FOREIGN PATENT DOCUMENTS

| | | |
|---|---|---|
| 0372479 | 6/1990 | European Pat. Off. . |
| 0604977 | 7/1994 | European Pat. Off. . |
| 0632344A2 | 1/1995 | European Pat. Off. . |
| 0668549A2 | 8/1995 | European Pat. Off. . |
| 63-313182 | 12/1888 | Japan . |
| 1-263679 | 10/1989 | Japan . |
| 2-157878 | 6/1990 | Japan . |
| 3-089482 | 4/1991 | Japan . |
| 5-135849 | 6/1993 | Japan . |
| 7-201455 | 8/1995 | Japan . |
| 9-080940 | 3/1997 | Japan . |
| 9-197861 | 7/1997 | Japan . |

*Primary Examiner*—Teresa Walberg
*Assistant Examiner*—Shawntina Fuqua
*Attorney, Agent, or Firm*—W. F. Fasse; W. G. Fasse

[57] ABSTRACT

A heater for fixing a toner image suffers no cracking of the ceramics substrate, thereof has a high connection reliability between an electrode and a connector thereof, and capable of attaining an improved fixing speed and a size increase of a transfer material. The heater, which is adapted to heat and fix a toner image on a transfer material, comprises a ceramics substrate containing silicon nitride and a heat generator formed on the ceramics substrate. The thermal conductivity and the transverse rupture strength of the silicon nitride forming the ceramics substrate are preferably at least 40 W/mK and at least 50 kg/mm$^2$ respectively, and the thickness of the ceramics substrate can be reduced to 0.1 to 0.5 mm.

16 Claims, 2 Drawing Sheets

CERAMIC FIXING HEATER CONTAINING SILICON NITRIDE

CROSS-REFERENCE TO RELATED APPLICATION

This application is related to commonly assigned copending U.S. application Ser. No. 08/940,635, filed Sep. 30, 1997.

BACKGROUND OF THE INVENTION

1. Field of the Invention

The present invention relates to a ceramics heater employed for a toner image heating and fixing device in a facsimile, a copying machine, a printer or the like.

2. Description of the Prior Art

In general, a toner image heating and fixing device in an image forming apparatus such as a facsimile, a copying machine or a printer transfers a toner image formed on a photoreceptor drum onto a transfer material and thereafter heats and pressurizes the transfer material while holding and transporting the same between a heating roller and a pressure roller, thereby fixing the unfixed toner image onto the transfer material. The conventional heating roller employed in the heating and fixing device is formed by setting a heat source such as a halogen lamp in a cylindrical metal roll for heating a surface part of the metal roll.

A toner image heating and fixing device employing a ceramics heater as a heating part thereof has been recently proposed and put into practice. The ceramics heater employed for such a device comprises a thin plate type electrical insulating ceramics substrate, a linear heat generator provided on a surface thereof and a protective layer of glass or the like covering a surface of the heat generator, and heat generator is energized for heating. A heating and fig device employing such a ceramics heater is described in Japanese Patent Laying-Open Nos. 1-263679 (1989), 2-157878 (1990), 63-313182 (1988) or the like, for example.

FIG. 1 shows an example of such a heating and fixing device. Referring to FIG. 1, a ceramics heater 1 of the aforementioned type is mounted on a support 2 of resin and a heat-resistant film 3 is rotatably provided on the outer peripheral portion of the support 2, while a pressure roller 4 is arranged to face the ceramics heater 1 through the heat-resistant film 3. A transfer material 5 having unfixed toner images 6*a* is held between the pressure roller 4 and the heat-resistant film 3 and carried or transported at a constant speed, so that toner images 6*b* are fixed onto the transfer material 5 due to pressurization by the pressure roller 4 and heating by the ceramics heater 1.

This heating and fixing device can reduce power consumption since the heat capacity of the ceramics heater is extremely smaller than that of the conventional metal roll, and is excellent in quick start performance since the heater requires no preheating upon switching on the power supply. The ceramics substrate forming the ceramics heater is generally prepared from alumina ($Al_2O_3$).

In recent years, a higher fixing speed is required for the heating and fixing device employing the aforementioned ceramics heater. While the current ceramics heater employing an alumina substrate has a fixing speed of 4 to 8 ppm (pages per minute) for A4 (Japanese Industrial Standard) papers, a higher speed of at least 12 ppm is recently required.

In the ceramics heater, a voltage of 100 or 200 V is generally applied to one or each end of the heat generator to generate Joule heat of at least several 100 W, thereby increasing the temperature of the heater to about 200° C. in about two to six seconds. When the fixing speed is increased, the time for transmitting the heat from the heater to each paper is reduced. However, a constant heating value is necessary for fixing the toner image and hence the heater must supply a larger quantity of heat per unit time, followed by application of a larger thermal shock to the heater.

In the ceramics heater employing an alumina substrate, however, a temperature difference arises between a portion around the heat generator and the remaining portion since alumina has a relatively small thermal conductivity of not more than 20 W/mK. On the other hand, such temperature difference results in thermal stress since alumina has a relatively large thermal expansion coefficient of 7.3 ppm/° C. Therefore, the general alumina substrate is easy to crack when the temperature of the heater is increased. Thus, the alumina substrate is unsuitable for high- speed processing involving a large thermal shock.

To this end, a ceramics heater employing a substrate of aluminum nitride (AlN) in place of the alumina substrate having inferior thermal shock resistance has been recently developed, as described in Japanese Patent Laying-Open Nos. 9-80940 (1997) or 9-197861 (1997). According to Japanese Patent Laying-Open No. 9-80940, the temperature responsiveness of the heater is improved due to the high thermal conductivity of aluminum nitride. According to Japanese Patent Laying-Open No. 9-197861, on the other hand, improvement of fixability, capability of high-speed printing and reduction of power consumption are attained through the high thermal conductivity of aluminum nitride.

As hereinabove described, the conventional ceramics heater for a heating and fixing device employs a ceramics substrate of alumina or aluminum nitride. However, the ceramics heater employing an alumina substrate is unsuitable for improving the fixing speed since the substrate is readily cracked by a thermal shock. Whether the ceramics heater employs the alumina substrate or the aluminum nitride substrate, further, a defective connection is readily caused between the electrodes of the heat generator and a connector, to result in inferior connection reliability, especially correpondingly following a size increase of the transfer material.

The heating and fixing device is also required to fix a toner image onto a large-sized transfer material such as an A3 (Japanese Industrial Standard) paper, for example. However, the conventional heating and fixing device for fixing a toner image onto an A4 paper while vertically carrying the A4 (Japanese Industrial Standard) paper cannot fix the image onto an A3 paper. In order to attain fixation of the toner image onto the A3 paper, therefore, the length of the ceramics heater is increased.

In this case, the length of the heat generator provided on the ceramics substrate is remarkably increased from about 220 mm for the A4 paper to about 300 mm for the A3 paper, and the temperature of the heat generator reaches about 200 to 250° C. Following heat generation of the heater, the alumina substrate is thermally expanded by 0.32 mm for the A4 paper or by 0.44 mm for the A3 paper when the heater temperature is 225° C. and the room temperature is 20° C., for example. The connector which is formed on the support for feeding the heat generator is generally prepared by plating a conductor mainly composed of copper having a low small resistance with a metal such as Ni for ensuring heat resistance.

When the ceramics substrate is expanded due to heat generation of the heater as hereinabove described, therefore, the metal such as Ni plated on the surface of the connector provided on the support readily comes off due to friction with the electrodes of the heat generator provided on the ceramics substrate, to expose the copper. The exposed copper is rapidly oxidized in the portions connected with the electrodes due to application of heat from the heater to form CuO having no conductivity, leading to defective connection between the connector and the electrodes of the heat generator.

The substrate of aluminum nitride having a smaller thermal expansion coefficient than alumina hardly causes the aforementioned problem of defective connection between the electrodes and the connector resulting from expansion of the substrate. However, the thermal conductivity of aluminum nitride is so high that heat generated in the heat generator is readily transmitted to the connector of a feeder part. Thus, the copper forming the connector is readily oxidized by the heat, to result in defective connection between the electrodes and the connector due to the oxidation.

SUMMARY OF THE INVENTION

In consideration of the aforementioned circumstances and the requirement for improvement of the fixing speed and size increase of the transfer material, an object of the present invention is to provide a ceramics heater for fixing a toner image having high connection reliability between an electrode and a connector, which can uniformly fix a toner image with no cracking of a ceramics substrate.

In order to attain the aforementioned object, the ceramics heater for fixing a toner image according to the present invention, which is adapted to heat and fix a toner image formed on a transfer material, comprises a ceramics substrate containing silicon nitride and a heat generator formed on the ceramics substrate.

In the ceramics heater for fixing a toner image according to the present invention, the thermal conductivity of silicon nitride forming the ceramics substrate is preferably at least 40 W/mK, and more preferably at least 80 W/mK. Further, the transverse rupture strength of silicon nitride forming the substrate is preferably at least 50 kg/mm$^2$, and more preferably at least 100 kg/mm$^2$.

In the ceramics heater for fixing a toner image according to the present invention, the thickness of a portion between a surface of the ceramics substrate provided with the heat generator and a surface opposite thereto can be reduced to 0.1 to 0.5 mm. According to the present invention, further, the heat generator, which is generally formed on a surface of the ceramics substrate facing the transfer material, can instead be formed on the surface of the substrate opposite to that facing the transfer material due to reduction of the thickness of the ceramics substrate.

According to the present invention, the ceramics heater for a heating and fixing device employs a silicon nitride substrate as the substrate therefor, whereby no cracking is caused on the substrate while the electrode and the connector can be prevented from suffering a defective connection. Thus, the present invention can provide a ceramics heater for fixing a toner image which can attain reduction of power consumption, improvement of the fixing speed and size increase of the transfer material.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
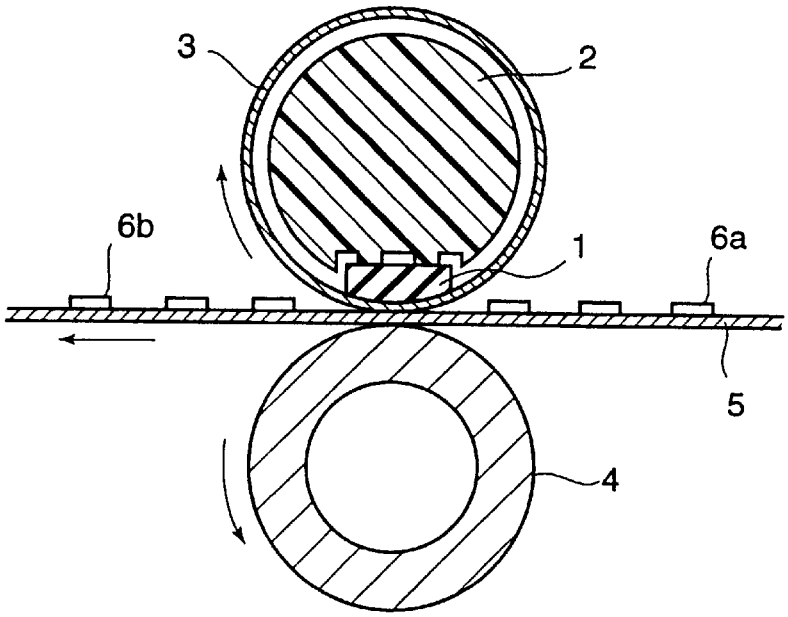
FIG. 1 PRIOR ART
FIG. 1 is a schematic sectional view showing a conventional heating and fixing device employing a ceramics heater.
Figure 2:
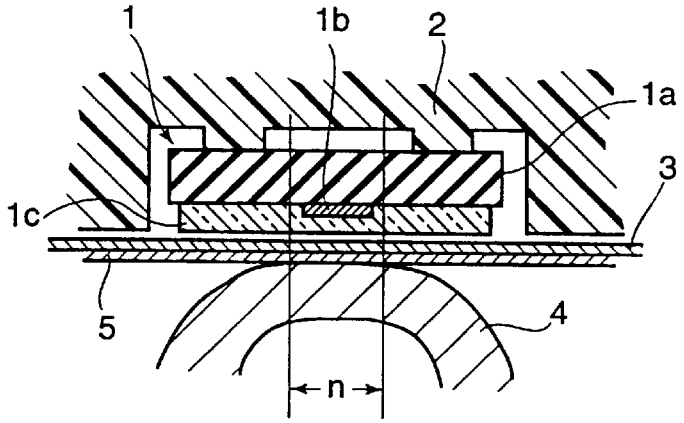
FIG. 2 is a schematic sectional view showing a principal part of a heating and fixing device according to an embodiment of the present invention.
Figure 3:
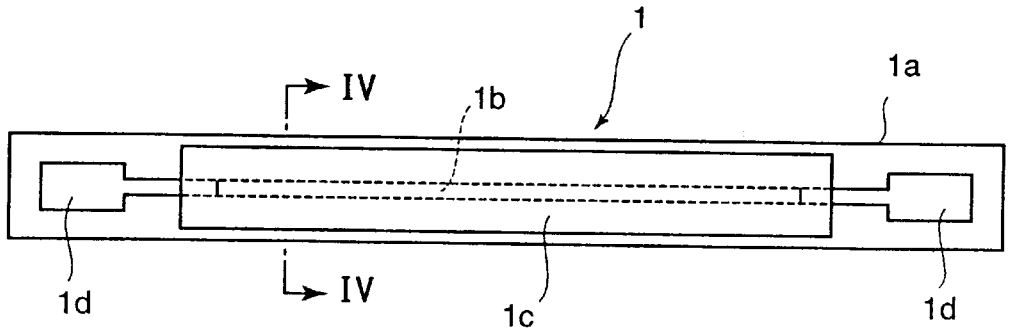
FIG. 3 is a schematic front elevational view showing a ceramics heater according to an Example of the present invention.
Figure 4:
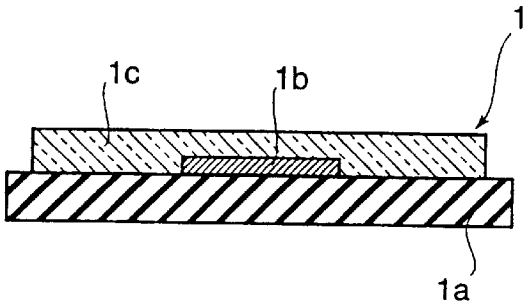
FIG. 4 is a schematic sectional view of the ceramics heater taken along the line IV—IV in FIG. 3.

According to the present invention, silicon nitride ($Si_3N_4$) is employed as the material for a ceramics substrate 1*a* of a ceramics heater 1. In this ceramics heater 1, the ceramics substrate 1*a* a contains silicon nitride and a heat generator 1*b* is formed on this ceramics substrate 1*a*, as shown in FIG. 2, so that the entire length and width of the heat generator 1*b* is formed and supported on the longer and wider ceramics substrate 1*a* as shown in FIGS. 3 and 4. The heat generator 1*b* can be covered with a protective layer 1*c* of glass or the like, similarly to a general heat generator.

The ceramics heater 1 according to the present invention is mounted on a support 2 of resin and a heat-resistant film 3 is rotatably provided on the outer peripheral portion of the support 2. Also, a pressure roller 4 is arranged to face the ceramics heater 1 through the heat-resistant film 3, thereby forming a heating and fixing device. The fixing system of this heating and fixing device is generally similar to that of the prior art. Namely, a transfer material 5 is held between the pressure roller 4 and the heat-resistant film 3 and carried or transported at a constant speed so that an unfixed toner image is fixed to the transfer material 5 on a contact portion (nip portion) between the pressure roller 4 and the heat-resistant film 3 by pressurization and heating.

As compared with the conventional alumina substrate, the silicon nitride substrate according to the present invention causes less thermal stress since the thermal conductivity of silicon nitride is equivalent to or higher than that of alumina and the heat expansion coefficient thereof is smaller than that of alumina. Further, the transverse rupture strength of silicon nitride is remarkably larger than that of alumina. Thus, the silicon nitride substrate, which is remarkably superior in thermal shock resistance to the alumina substrate, can prevent cracking resulting from thermal stress and is suitable for a higher fixing speed.

Further, the silicon nitride substrate can attain excellent connection reliability between electrodes of the heat generator and a connector. The thermal expansion coefficient of silicon nitride is about $2.8\times10^{-6}$/K or ppm/° C., and hence thermal expansion of the silicon nitride substrate following heat generation of the heater is only about 40% of that of the alumina substrate. Thus, the silicon nitride substrate is less expanded and it is possible to prevent such a problem whereby copper is exposed due to separation of a metal such as Ni plated on a surface of the connector and oxidized in portions connected with the electrodes due to application of heat from the heater. Consequently, no defective connection is caused between the connector and the electrodes of the heat generator by expansion of the substrate.

In addition, the thermal conductivity of silicon nitride cannot be so high as that of aluminum nitride even at the maximum. Therefore, the heat generated in the heat generator is not readily transmitted to the connector of a feeder part dissimilarly to the conventional aluminum nitride substrate, whereby copper forming the connector can be prevented from oxidation by the transmitted heat. Consequently, defective connection between the connector and the electrodes of the heat generator resulting from thermal oxidation of copper forming the connector can also be prevented in the ceramics heater comprising the silicon nitride substrate according to the present invention.

The thermal conductivity of the silicon nitride substrate according to the present invention is preferably at least 40 W/mK, and more preferably at least 80 W/mK. If the thermal conductivity is less than 40 W/mK, thermal shock resistance of the substrate is reduced and temperature distribution in the heater is increased. Particularly when the thermal conductivity is in excess of 80 W/mK, the temperature distribution in the substrate and the nip portion can be so reduced that the difference between a nip width n (see FIG. 2) and the substrate width can be reduced and the substrate width of the heater can be relatively reduced. Further, power consumption of the heater can be reduced by reducing the substrate width.

The transverse rupture strength of the silicon nitride substrate is preferably at least 50 kg/mm$^2$, and more preferably at least 100 kg/mm$^2$. If the transverse rupture strength is less than 50 kg/mm$^2$, the substrate is readily broken by a thermal shock as described above. If the transverse rupture strength is in excess of 100 kg/mm$^2$, the thickness of the substrate can be reduced to about not more than 0.5 mm and at least 0.1 mm. If the substrate is reduced in thickness, the material cost can be advantageously reduced and the energy can also be advantageously saved since the heat capacity of the heater is reduced substantially in proportion to the thickness of the substrate.

Particularly when the thickness of the substrate is reduced due to employment of such high-strength silicon nitride, the heat is so readily transmitted that the heat generator can be formed on a surface of the substrate opposite to a surface (fixing surface) of the substrate facing the transfer material. When the heat generator is provided on the surface opposite to the transfer material, the heat generated from the heat generator reaches the transfer material without passing through the protective layer of glass or the like having low thermal conductivity in general. Thus, the heat can be more quickly transmitted from the silicon nitride substrate to the transfer material while a constant temperature can be obtained as a whole, whereby a homogeneous toner image can be stably obtained in addition to the effect of saving energy due to reduction of the heat capacity.

When a surface of a material which is isothermally held at a temperature $T_1$ as a whole comes into contact with a heat source of a temperature $T_2$, the temperature T(t) of the surface facing the heat source after t seconds is expressed as follows:

$$T(t)=T_1+(T_2-T_1)\{1-\exp(-t/RC)\}$$

where R represents heat resistance between the surfaces of the material and the heat source and C represents heat capacity.

It is understood from the above expression that the product RC serves as the measure of the temperature programming rate for the surface of the material. The heat resistance R and the heat capacity C are substantially proportional to the thickness of the material, whereby the product RC is proportional to the square of the thickness. Thus, the temperature programming time can be reduced to ¼ when the thickness of the substrate is halved while the former can be reduced ⅙ by reducing the latter to ⅓, thereby remarkably improving the fixing performance.

The silicon nitride substrate according to the present invention can be prepared by a general method of adding a sintering assistant of yttrium oxide, alumina or the like to silicon nitride powder and sintering the obtained mixture.

EXAMPLE

Mixtures obtained by adding at least two powder materials of $Y_2O_3$, $Al_2O_3$, MgO and $ZrO_2$ to $Si_3N_4$ powder as sintering assistants were shaped into sheets and thereafter debindered and sintered, for preparing silicon nitride sintered bodies of samples ① to ⑦. Table 1 shows combinations of the powder materials and sintering and HIP (hot isostatic pressing) conditions.

TABLE 1

| Sample | Combination of Powder Material (wt. %) | | | | | Sintering Condition | HIP Condition (° C. × air pressure × hr) |
|---|---|---|---|---|---|---|---|
| | $Si_3N_4$ | $Y_2O_3$ | $Al_2O_3$ | MgO | $ZrO_2$ | (° C. × hr) | |
| ① | 93 | 5 | 2 | — | — | 1800 × 3 | — |
| ② | 95 | 3 | 2 | — | — | 1800 × 3 | — |
| ③ | 94.5 | 5 | 0.5 | — | — | 1700 × 3 | 1800 × 10 × 1 |
| ④ | 92 | 5 | 2 | 1 | — | 1700 × 3 | 1700 × 10 × 1 |
| ⑤ | 93.5 | 5 | 0.5 | 1 | — | 1700 × 3 | 1800 × 10 × 1 |
| ⑥ | 88 | 5 | 2 | — | 5 | 1700 × 3 | 1800 × 10 × 1 |
| ⑦ | 95 | 4 | 0 | 1 | — | 1700 × 3 | 1850 × 10 × 3 |

For the purpose of comparison, mixtures obtained by adding 3 percent by weight of MgO powder, 2 percent by weight of $SiO_2$ powder and 2 percent by weight of $CaCO_3$ powder to 93 percent by weight of $Al_2O_3$ powder were sintered in a humidified nitrogen/hydrogen atmosphere at 160° C., for preparing alumina sintered bodies.

The obtained silicon nitride sintered bodies and alumina sintered bodies were cut into 300 mm in length and 10 mm in width and polished into thicknesses shown in Tables 2 and 3, for obtaining ceramics substrates. Thereafter Ag—Pd paste and Ag paste were screen-printed on each ceramics substrate 1*a* in patterns for a heat generator 1*b* and electrodes 1*d* respectively and thereafter fired in the atmosphere at 890° C. thereby forming the heat generator 1*b* and the electrodes 1*d*, as shown in FIGS. 3 and 4. Then, glass was screen-printed on the heat generator 1*b* and fired in the atmosphere at 750° C., thereby providing a protective layer 1*c*. When silicon nitride having thermal conductivity of at least 50 W/mK was employed, it was possible to reduce the width of the heat generator 1*b* due to the excellent thermal conductivity and hence the width of the ceramics substrate 1*a* was reduced to 7.5 mm.

Figure 5:
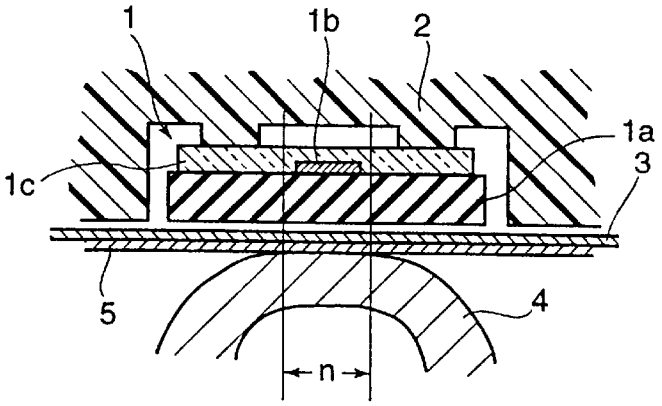
FIG. 5 is a schematic sectional view showing a principal part of a heating and fixing device according to another embodiment of the present invention.

Each ceramics heater 1 employing the ceramics substrate 1*a* of silicon nitride or alumina was mounted on a support 2 of resin so that the protective layer 1*c* defined a surface (fixing surface) facing a transfer material 5 as shown in FIG. 2 or the ceramics substrate 1*a* defined the fixing surface as shown in FIG. 5. Thereafter a pressure roller 4 and a heat-resistant film 3 were arranged to form a heating and fixing device.

Each heating and fixing device was subjected to a thermal shock resistance test and a fixability test for the ceramics heater 1. In the thermal shock resistance test, the pressure roller 4 and the heat-resistant film 3 were rotated at a constant speed while a voltage and a current applied, to the heat generator 1*b* were so adjusted as to increase the temperature of each ceramics heater 1 to the level shown in Table 2 in five seconds, the ceramics heater 1 was kept at the temperature level for 30 seconds, and thereafter energization and rotation of the pressure roller 4 and the heat-resistant film 3 were stopped for investigating whether or not the ceramics substrate 1*a* was broken. When the ceramics substrate 1*a* was unbroken, the ceramics heater 1 was cooled to room temperature and thereafter the test was repeated 1000 times at the maximum until the ceramics substrate 1*a* was broken. On the other hand, the fixability test was carried out at a fixing speed of 12 ppm, for evaluating power consumption for single printing and fixability. Tables 2 and 3 show the results of the thermal shock resistance test and the fixability test respectively.

TABLE 2

| | Thickness of Substrate (mm) | Transverse Rupture Strength (kg/mm$^2$) | Thermal Conductivity (W/m K.) | Temperature of Heater (° C.) | Repeat Count up to Breakage of Substrate |
|---|---|---|---|---|---|
| $Al_2O_3$ | 0.8 | 30 | 20 | 200 | unbroken up to 1000th test |
| $Al_2O_3$ | 0.6 | 30 | 20 | 200 | unbroken up to 1000th test |
| $Al_2O_3$ | 0.5 | 30 | 20 | 200 | broken in 185th test |
| $Al_2O_3$ | 0.8 | 30 | 20 | 250 | broken in 5th test |
| $Al_2O_3$ | 0.6 | 30 | 20 | 250 | broken in 5th test |
| $Si_3N_4$① | 0.6 | 50 | 20 | 250 | unbroken up to 1000th test |
| $Si_3N_4$① | 0.4 | 50 | 20 | 250 | unbroken up to 1000th test |
| $Si_3N_4$① | 0.3 | 50 | 20 | 250 | unbroken up to 1000th test |
| $Si_3N_4$① | 0.25 | 50 | 20 | 250 | broken in 850th test |
| $Si_3N_4$④ | 0.25 | 100 | 20 | 250 | unbroken up to 1000th test |
| $Si_3N_4$③ | 0.25 | 50 | 50 | 250 | unbroken up to 1000th test |
| $Si_3N_4$③ | 0.15 | 50 | 50 | 250 | broken in 271st test |
| $Si_3N_4$⑦ | 0.15 | 80 | 100 | 250 | unbroken up to 1000th test |
| $Si_3N_4$⑤ | 0.15 | 100 | 50 | 250 | unbroken up to 1000th test |
| $Si_3N_4$⑤ | 0.1 | 100 | 50 | 250 | unbroken up to 1000th test |
| $Si_3N_4$⑥ | 0.6 | 50 | 12 | 250 | broken in 756th test |
| $Si_3N_4$② | 0.6 | 45 | 20 | 250 | broken in 963rd test |

TABLE 3

| Substrate Sample | Thickness of substrate (mm) | Transverse Rupture Strength (kg/mm$^2$) | Thermal Conductivity (W/m K.) | Fixing Surface | Fixability | Power Consumption (Wh) |
|---|---|---|---|---|---|---|
| $Al_2O_3$ | 0.8 | 32 | 20 | glass | ○ | 1.48 |
| $Al_2O_3$ | 0.8 | 32 | 20 | ceramics | Δ | 1.35 |
| $Al_2O_3$ | 0.6 | 32 | 20 | glass | ○ | 1.30 |
| $Al_2O_3$ | 0.6 | 32 | 20 | ceramics | ○ | 1.31 |
| $Si_3N_4$① | 0.6 | 50 | 20 | glass | ○ | 1.25 |
| $Si_3N_4$① | 0.6 | 50 | 20 | ceramics | ○ | 1.24 |

TABLE 3-continued

| Substrate Sample | Thickness of substrate (mm) | Transverse Rupture Strength (kg/mm$^2$) | Thermal Conductivity (W/m K.) | Fixing Surface | Fixability | Power Consumption (Wh) |
|---|---|---|---|---|---|---|
| $Si_3N_4$⑥ | 0.6 | 50 | 12 | glass | Δ | 1.29 |
| $Si_3N_4$⑥ | 0.6 | 50 | 12 | ceramics | Δ | 1.21 |
| $Si_3N_4$⑦ | 0.6 | 80 | 100 | glass | ◎ | 1.27 |
| $Si_3N_4$⑦ | 0.6 | 80 | 100 | ceramics | ◎ | 1.23 |
| $Si_3N_4$① | 0.4 | 50 | 20 | glass | ○ | 1.20 |
| $Si_3N_4$① | 0.4 | 50 | 20 | ceramics | ○ | 1.09 |
| $Si_3N_4$① | 0.3 | 50 | 20 | glass | ○ | 1.18 |
| $Si_3N_4$① | 0.3 | 50 | 20 | ceramics | ○ | 0.94 |
| $Si_3N_4$④ | 0.25 | 100 | 20 | glass | ○ | 0.98 |
| $Si_3N_4$④ | 0.25 | 100 | 20 | ceramics | ◎ | 0.85 |
| $Si_3N_4$④ | 0.2 | 100 | 20 | glass | ○ | 0.71 |
| $Si_3N_4$④ | 0.2 | 100 | 20 | ceramics | ◎ | 0.64 |
| $Si_3N_4$④ | 0.1 | 100 | 20 | glass | ○ | 0.50 |
| $Si_3N_4$④ | 0.1 | 100 | 20 | ceramics | ◎ | 0.40 |
| $Si_3N_4$③ | 0.3 | 50 | 50 | glass | ◎ | 1.02 |
| $Si_3N_4$③ | 0.3 | 50 | 50 | ceramics | ◎ | 0.94 |

(Note) evaluation of fixability:
◎: remarkably excellent
○: excellent
Δ: slightly defective Then, durability of a connector was evaluated in relation to each of an alumina substrate, an aluminum nitride substrate and the silicon nitride substrates of the samples ① and ⑦ in Table 1. Each ceramics substrate was cut and worked into 400 mm in length, 15 mm in width and 0.8 mm in thickness, for preparing a ceramics heater similarly to the above. The ceramics heater was mounted on a support so that a protective layer defined a fixing surface, thereby forming a heating and fixing device similarly to the above.

The durability test for the connector was carried out by increasing the temperature of the ceramics heater to 225° C. in five seconds and thereafter fixing a toner image onto an unfixed A3 (Japanese Industrial Standard) paper. The time for fixing the toner image onto each A3 paper was adjusted to 10 seconds. The connector was prepared from Ni-plated copper, and fixation was repeated until the connector caused defective conduction. Table 4 shows the results.

TABLE 4

| Substrate Sample | Thermal Conductivity (W/mK) | Repeat Count up to Defective Conduction |
|---|---|---|
| $Si_3N_4$① | 20 | conductive after 1000th fixation |
| $Si_3N_4$⑦ | 100 | conductive after 1000th fixation |
| $Al_2O_3$ | 20 | non-conductive in 263rd fixation |
| AlN | 170 | non-conductive in 388th fixation |

In the above durability test, contact resistance of the connector for the alumina substrate started to rise during the 250th fixation, and the connector became non-conductive in the 263rd fixation. Also in the aluminum nitride substrate, contact resistance of the connector rose during the 380th fixation, and the connector became non-conductive in the 388th fixation. In each of the inventive samples, on the other hand, the connector caused neither increase of contact resistance nor defective conduction after the 1000th fixation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heater arrangement adapted for heating and fixing a toner image on a transfer material, said heater arrangement comprising a heater that comprises a ceramic substrate containing silicon nitride, and a heat generator formed on said ceramic substrate, wherein the entirety of said heat generator is formed on and supported by said ceramic substrate.

2. The heater arrangement in accordance with claim 1, wherein said ceramic substrate has a thermal conductivity of at least 40 W/mK.

3. The heater arrangement in accordance with claim 1, wherein said ceramic substrate has a thermal conductivity of at least 80 W/mK.

4. The heater arrangement in accordance with claim 1, wherein said ceramic substrate has a transverse rupture strength of at least 50 $kg/mm^2$.

5. The heater arrangement in accordance with claim 1, wherein said ceramic substrate has a transverse rupture strength of at least 100 $kg/mm^2$.

6. The heater arrangement in accordance with claim 1, wherein said ceramic substrate has a thickness of 0.1 to 0.5 mm between a first surface of said ceramic substrate on which said heat generator is formed and a second surface opposite thereto.

7. The heater arrangement in accordance with claim 1, wherein said heat generator is formed on a surface of said ceramic substrate adapted and arranged to face toward said transfer material.

8. The heater arrangement in accordance with claim 1, wherein said heat generator is formed on a surface of said ceramic substrate adapted and arranged to face away from said transfer material.

9. The heater arrangement in accordance with claim 1, wherein said ceramic substrate has a length and a width greater than said heat generator.

10. The heater arrangement in accordance with claim 1, wherein said ceramic substrate has a thickness of 0.15 to 0.3 mm.

11. The heater arrangement in accordance with claim 1, wherein said ceramic substrate essentially consists of a silicon nitride sintered body obtained by debindering and sintering a raw material powder mixture containing 5 to 8 wt. % of at least two sintering assistants selected from $Y_2O_3$, $Al_2O_3$, MgO and $ZrO_2$, and a balance of $Si_3N_4$.

12. The heater arrangement in accordance with claim 1, wherein said ceramic substrate has a thermal conductivity of at least 100 W/mK.

13. The heater arrangement in accordance with claim 1, wherein said heater essentially consists of said ceramic substrate, said heat generator formed on said ceramic substrate, electrodes formed on said ceramic substrate and connected to said heat generator, and a glass layer formed over said heat generator on said ceramic substrate.

14. The heater arrangement in accordance with claim 13, wherein said heater arrangement essentially consists of said heater, a resin support on which said heater is mounted, and a heat-resistant film arranged slidably adjacent said heater and said resin support.

15. The heater arrangement in accordance with claim 1, further comprising a resin support on which said heater is mounted, and a heat-resistant film slidably arranged adjacent said heater and said resin support, wherein said heat generator is formed on a surface of said ceramic substrate oriented toward said heat-resistant film and away from said resin support.

16. The heater arrangement in accordance with claim 1, further comprising a resin support on which said heater is mounted, and a heat-resistant film slidably arranged adjacent said heater and said resin support, wherein said heat generator is formed on a surface of said ceramic substrate oriented away from said heat-resistant film and toward said resin support.

* * * * *